US010245750B2

(12) United States Patent
Everhart

(10) Patent No.: US 10,245,750 B2
(45) Date of Patent: Apr. 2, 2019

(54) COMPOUND MITER APPARATUS

(71) Applicant: Duncan R. Everhart, Alum Bank, PA (US)

(72) Inventor: Duncan R. Everhart, Alum Bank, PA (US)

( * ) Notice: Subject to any disclaimer, the term of this patent is extended or adjusted under 35 U.S.C. 154(b) by 110 days.

(21) Appl. No.: 15/133,953

(22) Filed: Apr. 20, 2016

(65) Prior Publication Data

US 2017/0305031 A1 Oct. 26, 2017

(51) Int. Cl.
*B27G 5/02* (2006.01)
*B27B 27/08* (2006.01)

(52) U.S. Cl.
CPC ..... *B27G 5/02* (2013.01); *B27B 27/08* (2013.01); *Y10T 83/7697* (2015.04); *Y10T 83/857* (2015.04); *Y10T 83/8773* (2015.04)

(58) Field of Classification Search
CPC ..... B23D 59/002; B23D 59/003; B23Q 17/2233; G01B 5/242; Y10T 83/8773; Y10T 83/857; Y10T 83/7697
USPC ..... 83/522.15–522.24, 581, 471.3; 33/537, 33/640
See application file for complete search history.

(56) References Cited

U.S. PATENT DOCUMENTS 1,831,124 A * 11/1931 Koster ..... B27B 25/10 83/418
2,619,998 A * 12/1952 Okamuro ..... B23Q 3/005 144/253.8
3,423,885 A * 1/1969 Crandall ..... B23Q 3/104 269/902
3,586,075 A 6/1971 Larsen
3,736,666 A * 6/1973 Sutter ..... B23Q 1/5443 33/537
4,443,950 A * 4/1984 Cockeram ..... B23Q 17/22 33/418
4,461,196 A 7/1984 Schramm, II
4,884,604 A * 12/1989 Rice ..... B23Q 1/4828 144/134.1
4,927,125 A * 5/1990 Hunter ..... B23Q 1/0063 269/74
4,940,067 A 7/1990 Beard
5,014,443 A * 5/1991 Gibbens, III ..... B23D 59/002 33/640
5,016,358 A 5/1991 Rice et al.
(Continued)

FOREIGN PATENT DOCUMENTS

GB 2 288 763 A 1/1995

*Primary Examiner* — Laura M Lee
(74) *Attorney, Agent, or Firm* — Wendy W. Koba

(57) ABSTRACT

An apparatus for performing repeatable, accurate compound miter cuts takes the form of a gauge and associated plate that are attached to a conventional miter saw. The gauge includes a pair of hinged flaps that are adjustable so that the user can move the two flaps to correspond to the measured lean angle and the measured miter angle, creating the proper three-dimensional orientation for the compound miter cut. A separate plate member is attached to the saw itself (in a plane parallel to the saw blade), and is used as a guide to align the blade to the gauge. An associated set of pivot stops (for both the arm and the table) are used in conjunction with the gauge and the plate to form all possible combinations of inside and outside angles in a repeatable manner without needing to perform any calculations of the angles.

8 Claims, 5 Drawing Sheets

(56) References Cited

U.S. PATENT DOCUMENTS

| | | | | |
|---|---|---|---|---|
| 5,379,669 | A | 1/1995 | Roedig | |
| 5,816,129 | A | 10/1998 | Singer | |
| 5,865,079 | A | 2/1999 | Itzov | |
| 5,979,283 | A | 11/1999 | Osborne | |
| 6,182,548 | B1 | 2/2001 | Meredith et al. | |
| 6,604,296 | B2 | 8/2003 | Mastrobattista | |
| 6,848,350 | B2 | 2/2005 | Brazell et al. | |
| 7,421,798 | B2 | 9/2008 | Pattee | |
| 7,930,961 | B2 * | 4/2011 | Kozina | B23D 47/04 33/569 |
| 8,960,063 | B2 | 2/2015 | Kaye, Jr. et al. | |
| 2003/0230180 | A1 | 12/2003 | Hines | |
| 2004/0060412 | A1 | 4/2004 | Kao | |
| 2006/0048617 | A1 * | 3/2006 | Gehret | B23D 47/02 83/473 |
| 2006/0053992 | A1 | 3/2006 | Williams et al. | |
| 2007/0234864 | A1 * | 10/2007 | Bettacchini | B23D 47/025 83/471.3 |
| 2008/0041211 | A1 | 2/2008 | Gibbons et al. | |
| 2008/0250905 | A1 | 10/2008 | Khan | |
| 2013/0098216 | A1 | 4/2013 | Stuart et al. | |

* cited by examiner

ZERO SETTINGS

MITER/TILT LEFT

MITER/TILT RIGHT

COMPOUND MITER APPARATUS

TECHNICAL FIELD

The present invention relates to an apparatus for making compound miter cuts and, more particularly, to an apparatus that makes accurate, repeatable compound miter cuts of any configuration without the need for angle charts, computers or computation of mathematically-derived angle calculations.

BACKGROUND

Double bevel joinery is common to many woodworking and construction projects (e.g., crown molding, roof rafters, window sills, fascia, soffits, etc.). For any irregular angles off of 90°, the creation of two-axis (i.e., compound) miter cuts typically requires the use of angle charts, math functions or computer applications in conjunction with the miter saw itself. The accuracy of these solutions relies on the user's understanding of the required measurements, as well as the ability to accurately measure the various angles and transfer this information to the saw. Moreover, in many cases the need for a first compound miter cut requires the need for a second, opposite cut (e.g., "left-inside" corner cut to match a "right-inside" corner cut). In conventional systems, the need for this second cut usually requires that the saw be re-set, using the angle gauges, to the new angular positions. This need to use the angle gauges twice to make opposite cuts may lead to inaccuracies and mismatch to the original angle.

SUMMARY OF THE INVENTION

The problems associated with the prior art are addressed by the present invention, which relates to a "no-math" apparatus for making compound miter cuts and, in particular, to an apparatus that makes accurate, repeatable compound miter cuts of any configuration without the need for angle charts, computers or computation of mathematically-derived angle calculations. The apparatus is suitable for use in making compound miter cuts in any material: wood, metal, plastic, etc.

In accordance with the present invention, the inventive apparatus takes the form of a gauge and associated plate that are attached to conventional miter saw. The gauge includes a pair of hinged flaps that are adjustable so that the user can move the two flaps to correspond to: (1) the measured lean (or spring) angle and (2) the measured miter angle (using the remaining flap to define the miter angle). Inasmuch as the pair of flaps are connected together (via an associated pair of hinges) to the gauge, the combination provides the proper three-dimensional orientation of the two angles with respect to each other as required for the compound miter cut. A separate plate member is attached to the housing of the saw itself (in a plane parallel to the saw blade), and is used as a guide to align the gauge to the blade when the cutting is initiated. That is, the plate is brought into physical contact with the second flap of the gauge, thus bringing the saw blade itself into the same angular position as the second flap.

In another embodiment of the present invention, an associated set of pivot devices (for both the arm and the table) are used in conjunction with the gauge and the plate to form all possible combinations of inside and outside angles in a repeatable manner—all without needing to perform any calculations of the angles, or refer to reference sources to find the proper position for the saw blade.

It is to be understood that the inventive apparatus may be used to perform compound miter cuts in any type of material—wood, metal, plastic, etc.

One exemplary embodiment of the present invention takes the form of a guide apparatus for performing compound miter cuts, the guide apparatus comprising a gauge and a guiding plate. The gauge includes a base support member, a first flap connected to the base support member along a first hinge, and a first locking angle guide connected between the base support member and the first flap, where the first flap is rotatable along the first hinge to define a predetermined lean angle, with the first locking angle guide used to fixedly hold the first flap in place at the predetermined lean angle orientation. The gauge also includes a second flap connected the first flap along a second hinge, the second hinge disposed perpendicular to the first hinge and a second locking angle guide connected between the first flap and the second flap, where the second flap is rotatable along the second hinge to define a predetermined miter angle, with the second locking angle guide used to fixedly hold the second flap in place with respect to the predetermined miter angle. The guiding plate is attached to the housing of a miter saw in a manner parallel to the saw blade, wherein upon initiating a compound miter cut, the second flap of the gauge is brought into contact with the plate to orient the saw blade to the desired compound angle as defined by the combination of the predetermined miter angle and the predetermined lean angle.

Other and further embodiments of the present invention will become apparent during the course of the following

BRIEF DESCRIPTION OF THE DRAWINGS

Referring now to the drawings, where like reference numerals represent like parts in several views.

DETAILED DESCRIPTION OF THE INVENTION

An apparatus for performing compound miter cuts quickly and easily—without the need to compute any of the cutting angles—has been developed. The apparatus takes the form of a guide that is easily attached to a miter saw and includes four separate components that work together to provide reproducible cuts of any desired compound angle. Advantageously, all four combinations of inside/outside, left/right angles can be cut without the need to re-configure the saw and re-set the angles.

As will be discussed in detail below, the inventive apparatus includes: (1) a gauge with a pair of flaps that are set to the measured lean angle (on the first flap) and the measured miter angle (on the second flap); (2) a plate that attaches to the housing of the saw blade (with the plate parallel to the saw blade), where the plate is brought into contact with the gauge to align the saw blade with the gauge; (3) an arm pivot index that defines the complementary angles associated with the bevel angle portion of the compound cut; and (4) a table pivot index that defines the complementary angles associated with the miter angle portion of the compound cut. The specific aspects of these components and how they work together to perform "no math" compound miter cuts will now be explained in detail.

Figure 1:
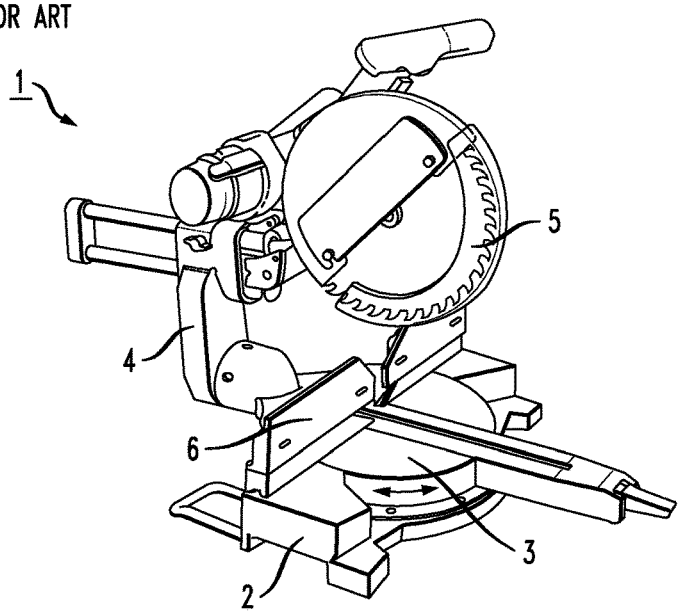
FIG. 1 PRIOR ART
FIG. 1 illustrates an exemplary prior art miter saw that may be configured with the inventive apparatus to perform compound miter cuts.
Figure 2:
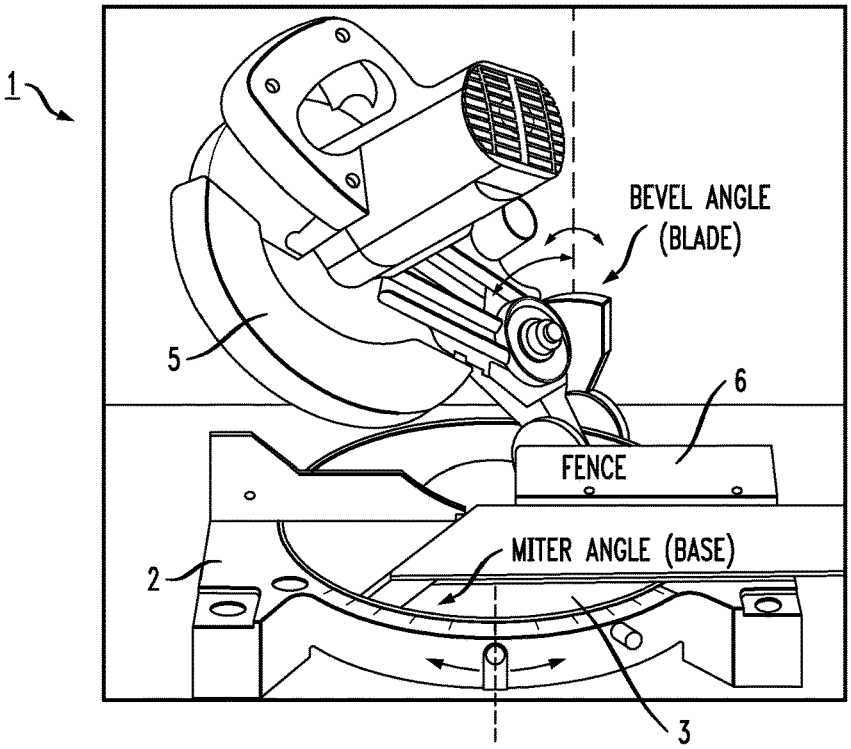
FIG. 2 PRIOR ART
FIG. 2 is another view of the prior art miter saw of FIG. 1.
Figure 3:
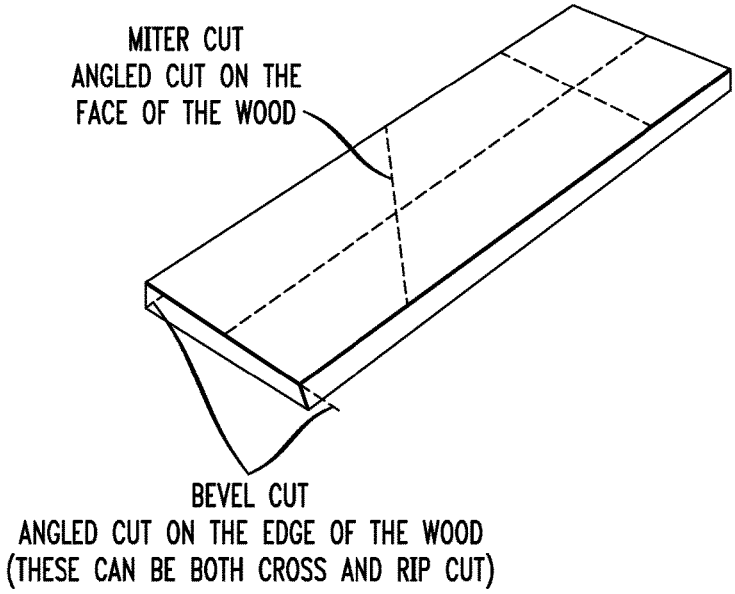
FIG. 3 PRIOR ART
FIG. 3 is a diagram illustrating the particulars of both a bevel cut and a miter cut.

Prior to describing the details of the inventive apparatus itself, the specifics of a miter saw and the various cuts will be reviewed. FIG. 1 is an isometric view of an exemplary conventional miter saw 1, including a base assembly 2, an angularly movable table 3, a housing assembly 4 (containing the motor to power the saw), a saw blade 5, and a work piece-supporting fence 6. FIG. 2 is another view of miter saw 1, illustrating in this case the ability to angularly adjust the position of saw blade 5 with respect to table 3. As will be discussed in detail below, the orientation of saw blade 5 in this manner defines the angle created by the bevel cut portion of the compound cut. The miter cut portion of the compound cut is controlled by adjusting the angle of table 3 with respect to blade 5. FIG. 3 is a diagram showing the location of both a miter cut and a bevel cut (as single cuts) within a work piece. As will be discussed in detail below, a "compound" miter cut requires a simultaneously adjustment of both of these angles.

Figure 4:
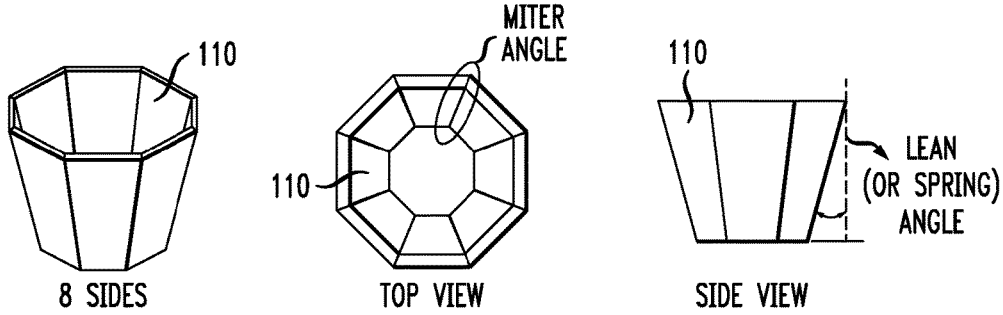
FIG. 4 PRIOR ART
FIG. 4 depicts the properties of a compound miter cut, with FIG. 4(*a*) illustrating a containing having a number of sidewalls formed with compound miter cuts, FIG. 4(*b*) is a top view of the container of FIG. 4(*a*), illustrating the associated miter angle, and FIG. 4(*c*) is a side view of the container, showing the lean angle.

FIG. 4 depicts the actual physical properties of a compound miter cut (as can be created by the inventive apparatus, discussed below). FIG. 4(*a*) depicts a container 100 formed of eight sections 110 having compound miter cuts. The miter angle portion of the compound cut is shown in the top view of FIG. 4(*b*) and the lean angle portion is shown in the side view of FIG. 4(*c*). As will be discussed in detail below, the lean angle measurement shown in FIG. 4(*c*) is the value used to adjust the setting of the first flap of the inventive gauge, and the miter angle measurement shown in FIG. 4(*b*) is the value used to adjust the setting of the second flap of the inventive gauge. Thus, by bringing a saw blade into alignment with the second flap, the proper compound cut along the length of each section 110 will be made, and the pieces can be joined together to form container 100.

With this understanding of the nomenclature, the inventive apparatus will be described. As mentioned above, the inventive apparatus includes four major components: a gauge, a plate, an arm pivot index and a table pivot index. All four components are necessary when the miter saw is to be configured to form all possible combinations of the compound cut (i.e., inner/outer and left/right combinations). In other cases where only a single cut is required, only the gauge and plate elements are used.

Figure 5:
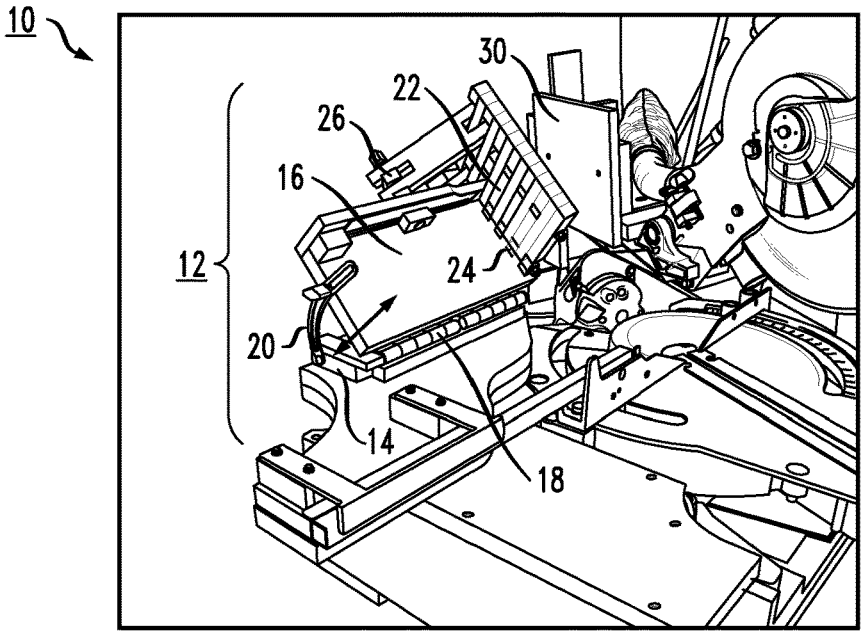
FIG. 5 is a diagram illustrating the exemplary gauge and plate components of the apparatus of the present invention.

FIG. 5 is a diagram illustrating the exemplary gauge and plate components of the inventive compound miter apparatus 10. In particular, a gauge component 12 is shown as including a base 14 that supports a first flap 16 attached to base 14 via a first hinge 18. Base 14 is attached to the base of the miter saw such that it moves parallel to the plane of the table and back fence. The angle of separation between first flap 16 and base 14 defines the lean angle portion of the compound miter cut (see FIG. 4(*c*)). In use, therefore, an individual would measure (or otherwise determine) the desired lean angle and rotate first flap 16 with respect to base 14 (via hinge 18) until this angle is achieved. Once the positioning of first flap 16 is obtained, an angle set screw 20 is used to "lock" this value for the lean angle of the bevel cut. Obviously, various other methods of locking the angled flap in place with respect to the based may be used.

Figure 6:
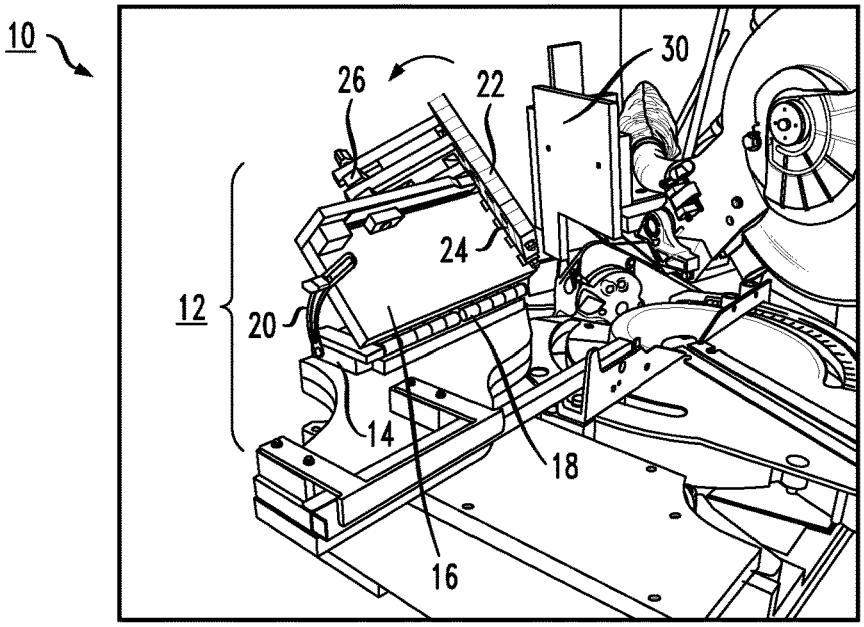
FIG. 6 is another view illustrating the attachment of the exemplary gauge and plate components of the present invention to a conventional saw mechanism.

Gauge component 12 further includes a second flap 22 that rotates with respect to first flap 16 via a hinge 24. As best shown in FIG. 6, hinge 24 is located such that second flap 22 rotates on a center in the same plane as first flap 16, and tangent to the center line of rotation of first flap 16. The orientation of second flap 22 with respect to first flap 16 defines the miter angle portion of the compound cut with respect to the predetermined lean angle. Again, the user performs a measurement (or similarly determines) the desired miter angle (see FIG. 4(*b*)) and adjusts the position of second flap 22 with respect to first flap 16, using hinge 24 to move second flap 22, until this angular separation for the miter cut is of the desired value. A second set screw 26 (or other mechanism) is used to lock second flap 22 in place. With these two flap settings, the inventive apparatus is able to create all four possible variations of the compound cut (inside-outside, left-right) without the need to perform any mathematical calculations, reference to tables, or other aids as used in previous designs.

Once gauge 12 is properly configured to define the compound angle, plate 30 (attached to the saw housing in a manner parallel to the blade itself) is brought into contact with (and aligned to) second flap 22 of gauge 12 so that the saw blade properly replicates the orientation required to make the compound cut through a work piece (not shown).

FIG. 6 clearly shows the location of an exemplary plate component 30 with respect to a miter saw. In particular, plate component 30 is attached to the miter saw so as to be parallel to the plane of the saw blade. Thus, the movement of the saw arm to bring plate component 30 into contact with second flap 22 of gauge component 12 will necessarily result in the rotation of the saw blade into the desired miter angle value. The alignment of plate 30 (front-to-back) with second flap 22 rotates the saw blade into the desired lean angle value. Therefore, the side-to-side and front-to-back movement of plate 30 to align with gauge 12 provides the necessary orientation of the saw blade to accurately perform the compound cut.

Figure 7:
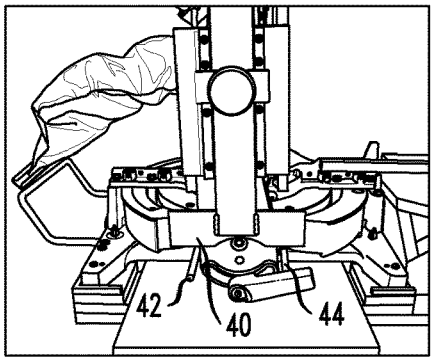
FIG. 7 is a diagram illustrating the location of an arm pivot index and associated pair of stops useful in performing complementary bevel angles within a compound miter cut.
Figure 8:
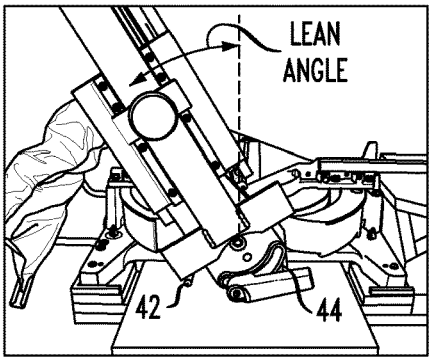
FIG. 8 shows the same configuration as in FIG. 7, in this case, with the saw blade rotated against one of the arm pivot index stops.

In order to perform all four possible combinations of inside and outside angles (as well as left-hand and right-hand angles), it is necessary to also define the complementary values of both the bevel and miter angles. These complementary values are created in the apparatus of the present invention by using an arm pivot index member 40 and a table pivot index member 50. FIGS. 7 and 8 illustrate the control of the saw blade range of motion with an arm pivot index member 40. FIG. 7 illustrates the configuration in the "original" position, with the saw blade oriented perpendicular to the plane of the work piece. The rotation of the blade with respect to the perpendicular (defining the bevel angle as defined above) is shown in FIG. 8. Although not shown in this view, it is to be understood that a gauge component is positioned to contact plate 30 when the saw is moved into this rotation. Arm pivot index member 40, which moves with the rotation of the saw blade, defines a first stop 42 at this particular position of the saw blade. A second stop 44 is located at the opposite end of member 40 and is aligned with first stop 42. Thus, when saw is rotated back to zero, and then moved in the opposite direction (i.e., the saw blade rotating to the right with respect to the perpendicular), the location of second stop 44 defines the proper complementary bevel angle and prevents any other orientation of the saw blade. Thus, arm pivot index member 40 defines both necessary bevel angles ("plus" and "minus" from the perpendicular) without needing the use of any measurements. The physical stops 42 and 44 provide the necessary limits to the orientation of the saw blade with respect to the workpiece.

Figure 9:
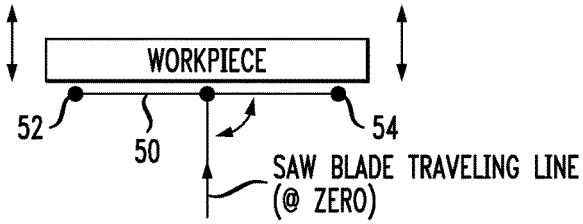
FIG. 9 is a diagram illustrating the location of a table pivot index and associated pair of stops useful in performing complementary miter angles within a compound miter cut.
Figure 10:
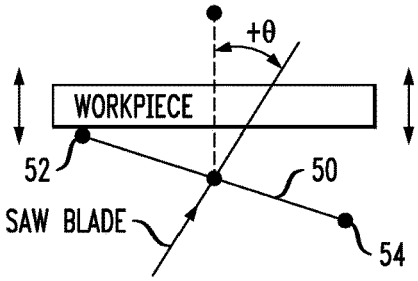
FIG. 10 shows the configuration of FIG. 9, with the table angled against a first one of the stops.
Figure 11:
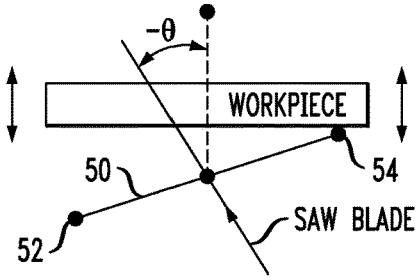
FIG. 11 illustrates the same configuration as FIGS. 9 and 10, in this case with the table angled against the opposing stop.
Figure 12:
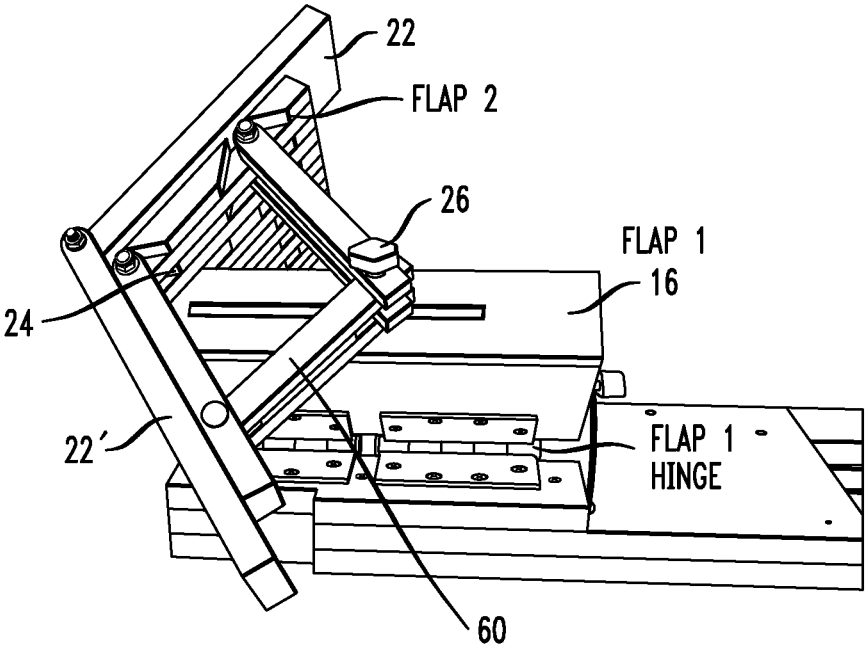
FIG. 12 illustrates an alternative configuration of the second flap as formed on the gauge component, where in this case a self-divided linkage configuration is utilized to simultaneously orient a pair of flaps at the complementary values of the desired miter cut.

FIGS. 9-11 illustrate a similar control of the movement of table pivot index member 50, used to provide physical "stops" for the complementary miter angles associated with the compound cut. FIGS. 9-11 are a view looking down from above a saw, with the direction of travel of the saw blade shown relative to a workpiece. FIG. 9 illustrates an "original" position of table pivot index member 50, where member 50 is parallel to the workpiece, and (that is, the saw blade is set at a miter angle of 0°), and a conventional cut through the thickness of the workpiece would be performed. FIG. 10 shows the positioning of index member 50 when plate 30 is properly aligned with gauge 12 in the manner discussed above. In this orientation, a first table stop 52 is fixed to define the miter angle (here, shown as $+\theta$). The desired miter cut is through the workpiece at the angle as shown. By virtue of member 50 having a pair of opposing stops along the same reference plane, an opposing second table stop 54 will automatically determine the complementary angle ($-\theta$) required for a cut in the opposite direction. FIG. 12 illustrates the orientation of the table when positioned against second table stop 54.

In accordance with the various components of the inventive apparatus as described thus far, the process used to perform a compound miter cut proceeds as described below.

First, the bevel cut portion of the desired compound cut is set by adjusting the position of first flap 16 with respect to base 14 to create the desired (measured) lean angle. First flap 16 is secured in this orientation so that no further movement during the cutting procedure is possible. Next, the desired miter angle is determined and set on second flap 22 (relative to first flap 16). Again, second flap 22 is fixedly held at this desired position.

Once these two angles are set, the position of gauge component 12, arm pivot 40 and table pivot 50 are all adjusted until plate 30 comes into contact with second flap 22 and is properly aligned with gauge 12. At this point, the arm and table pivots are set and the associated stops are locked to determine these positions (that is, defining all possible complementary angles associated with the compound cut). At this point, all of the desired surfaces of the compound miter cut have been set-without the need to perform any mathematical operations or reference to a table of angles. The user may then just proceed with moving the saw blade to make the cut.

If the user wishes to make a complementary cut, the only changes required are to move the position of the saw blade to align with the other arm and table stop locations (i.e., changing them to lock in the opposite direction). Once reset, the complementary cut may quickly and easily be performed.

In a preferred embodiment of the present invention, second flap 22 can be configured in a self-divide linkage configuration, as shown in FIG. 12. In this case, an additional linkage 60 allows for a "shadow" second flap 22' to be disposed at the same angle relative to first flap 16, but as measured with respect to the back surface of first flap 16. This configuration allows for the remaining two opposing compound cuts to be performed by adjusting the components until plate 30 aligns with shadow flap 22'.

The foregoing discussion discloses and describes merely exemplary embodiments of the present invention for purposes of illustration only. One skilled in the art will readily recognize from such discussion, and from the accompanying drawing and claims, that various changes, modifications, and variations can be made therein without departing from the spirit and scope of the invention as defined in the following claims.

What is claimed is:

1. A guide apparatus for performing compound miter cuts using a saw blade, the guide apparatus comprising a gauge including:

a base support member;

a first flap connected to the base support member along a first hinge;

a first locking angle guide connected between the base support member and the first flap, wherein the first flap is rotatable along the first hinge to define a predetermined lean angle, with the first locking angle guide used to fixedly hold the first flap in place at the predetermined lean angle orientation;

a second flap connected to the first flap along a second hinge, the second hinge disposed perpendicular to the first hinge; and a second locking angle guide connected between the first flap and the second flap, wherein the second flap is rotatable along the second hinge to define a predetermined miter angle, with the second locking angle guide used to fixedly hold the second flap in place with respect to the predetermined miter angle; and a plate for attaching to a miter saw in a manner parallel to the saw blade, wherein upon initiating a compound miter cut, the plate is brought into contact and aligned with the second flap of the gauge, thereby moving the saw blade to the desired compound angle as defined by the combination of the predetermined miter angle and the predetermined lean angle.

2. The guide apparatus as defined in claim 1 wherein the first locking angle guide comprises a slotted angle guide and a set screw disposed within the slotted angle guide.

3. The guide apparatus as defined in claim 1 wherein the second locking angle guide comprises a slotted angle guide and a set screw disposed within the slotted angle guide.

4. The guide apparatus as defined in claim 1 wherein the second flap is configured as a self-divided linkage comprising a first flap member oriented at the predetermined miter angle with the first flap and a second flap member oriented at a complementary miter angle with respect to a back surface of the first flap.

5. The guide apparatus as defined in claim 1 wherein the guide apparatus further comprises an arm pivot index member disposed to move with the rotation of the saw blade, the arm pivot index member including a pair of opposing stops to define complementary locations of a bevel angle portion of the compound cut.

6. The guide apparatus as defined in claim 1 wherein the apparatus further comprises a table pivot index member coupled to a cutting surface and including a pair of opposing stops to define complementary locations of the predetermined miter angle portion of the compound cut.

7. The guide apparatus as defined in claim 1 wherein the apparatus further comprises:

an arm pivot index member disposed to move with the rotation of the saw blade, the arm pivot index member including a pair of opposing stops to define complementary locations of a bevel angle portion of the compound cut; and a table pivot index member coupled to a cutting surface and including a pair of opposing stops to define complementary locations of the miter angle portion of the compound cut.

8. A guide apparatus for performing compound miter cuts using a saw blade, the guide apparatus comprising a gauge including:

a base support member;

a first flap connected to the base support member along a first hinge;

a first locking element connected between the base support member and the first flap, wherein the first flap is rotatable along the first hinge to define a predetermined lean angle, with the first locking element used to fixedly hold the first flap in place at the predetermined lean angle orientation;

a second flap connected to the first flap along a second hinge, the second hinge disposed perpendicular to the first hinge; and a second locking element connected between the first flap and the second flap, wherein the second flap is rotatable along the second hinge to define a predetermined miter angle, with the second locking element used to fixedly hold the second flap in place with respect to the predetermined miter angle;

a plate for attaching to a miter saw in a manner parallel to the saw blade, wherein upon initiating a compound miter cut, the plate is brought into contact and aligned with the second flap of the gauge, thereby moving the saw blade to the desired compound angle as defined by the combination of the predetermined miter angle and the angle;

an arm pivot index member disposed to move with the rotation of the saw blade, the arm pivot index member including a pair of opposing stops to define complementary locations of a bevel angle portion of the compound cut; and a table pivot index member coupled to a cutting surface and including a pair of opposing stops to define complementary locations of the miter angle portion of the compound cut.

* * * * *